US009589447B2

(12) United States Patent
Remer

(10) Patent No.: US 9,589,447 B2
(45) **Date of Patent: *Mar. 7, 2017**

(54) PERSONAL SAFETY SYSTEM, METHOD, AND APPARATUS

(71) Applicant: PERPCAST, INC., Seattle, WA (US)

(72) Inventor: David M. Remer, Seattle, WA (US)

(73) Assignee: PERPCAST, INC., Seattle, WA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/876,748

(22) Filed: Oct. 6, 2015

(65) Prior Publication Data

US 2016/0027291 A1 Jan. 28, 2016

Related U.S. Application Data

(63) Continuation of application No. 12/775,296, filed on May 6, 2010, now Pat. No. 9,177,455.
(Continued)

(51) Int. Cl.
*G08B 1/08* (2006.01)
*G08B 1/00* (2006.01)
(Continued)

(52) U.S. Cl.
CPC ..... *G08B 25/016* (2013.01); *G08B 15/004* (2013.01)

(58) Field of Classification Search
CPC G08B 25/08; G08B 25/016; G08B 13/19656; G08B 13/19673;
(Continued)

(56) References Cited

U.S. PATENT DOCUMENTS 7,058,409 B2 * 6/2006 Hanninen ..... H04W 64/00 348/14.01
8,385,883 B2 2/2013 Rajan et al.
(Continued)

FOREIGN PATENT DOCUMENTS

CA WO 2009052618 A1 * 4/2009 ..... G06F 17/241
CN 1565005 A 1/2005
(Continued)

OTHER PUBLICATIONS

Author: Pregne J; Title: Combined alarm, monitoring and communication device for e.g. police, sends recorded video sequences to alarm center before alarm is activated; Published Date: Jan. 14, 2007; Pertinent Pages: Whole Document.*
(Continued)

*Primary Examiner* — Steven Lim
*Assistant Examiner* — Muhammad Adnan
(74) *Attorney, Agent, or Firm* — Schwabe, Williamson & Wyatt, P.C.

(57) ABSTRACT

A personal safety system, method, and apparatus provides image, audio, and data capture and transport system (IAD-CTS) features wherein an electronic device placed on a user can capture data associated with a potential perpetrator of a crime against the user. The electronic device sends the captured data (such as images or audio) to a secure and remote storage location. The capturing and sending of the data cannot be reversed or canceled by the user or potential perpetrator. The potential perpetrator is notified that the potential perpetrator's data has been captured by the electronic device, thereby discouraging the potential perpetrator from further proceeding with the crime.

14 Claims, 4 Drawing Sheets

Related U.S. Application Data

(60) Provisional application No. 61/176,421, filed on May 7, 2009.

(51) Int. Cl.

| | |
|---|---|
| ***G08B 5/22*** | (2006.01) |
| ***G08B 25/00*** | (2006.01) |
| ***G08B 25/01*** | (2006.01) |
| ***G08B 15/00*** | (2006.01) |

(58) Field of Classification Search
CPC ..... G08B 13/19684; G08B 13/19689; G08B 21/0453; G08B 21/02
See application file for complete search history.

(56) References Cited

U.S. PATENT DOCUMENTS

| | | | | |
|---|---|---|---|---|
| 9,014,661 | B2 | 4/2015 | deCharms | |
| 2003/0080878 | A1 | 5/2003 | Kirmuss | |
| 2004/0164896 | A1* | 8/2004 | Evans | G01S 5/0027 342/357.31 |
| 2004/0201473 | A1 | 10/2004 | Lee | |
| 2004/0203842 | A1* | 10/2004 | Hanninen | H04W 64/00 455/456.1 |
| 2004/0226993 | A1* | 11/2004 | Fulcher | G06Q 30/0284 235/381 |
| 2005/0203349 | A1 | 9/2005 | Nanikashvili | |
| 2005/0233685 | A1* | 10/2005 | Fukase | B32B 15/02 454/1 |
| 2007/0042747 | A1 | 2/2007 | Sun | |
| 2008/0186162 | A1 | 8/2008 | Rajan et al. | |
| 2008/0297330 | A1* | 12/2008 | Jeon | B60R 25/102 340/426.11 |
| 2009/0181640 | A1 | 7/2009 | Jones | |
| 2009/0191839 | A1* | 7/2009 | Cannon, Jr. | G08B 25/009 455/404.1 |
| 2010/0099461 | A1 | 4/2010 | Rahfaldt et al. | |
| 2010/0117835 | A1 | 5/2010 | Nanikashvili | |
| 2014/0038544 | A1 | 2/2014 | Jones et al. | |
| 2014/0057590 | A1 | 2/2014 | Romero | |

FOREIGN PATENT DOCUMENTS

| | | | | |
|---|---|---|---|---|
| CN | 101344778 | A | 1/2009 | |
| GB | 2460535 | A | * 12/2009 | H04N 1/00307 |
| JP | 2000036091 | A | 2/2000 | |
| JP | 2005135204 | A | 5/2005 | |
| KR | 1020070039803 | A | 4/2007 | |
| KR | 1020070066455 | A | 6/2007 | |
| SE | 200700118 | A | 11/2008 | |

OTHER PUBLICATIONS

International Search Report and Written Opinion, for application PCT/US2010/034108, mailed on Nov. 30, 2010, 9 pages.
Office Action mailed Dec. 4, 2013 for Chinese Application No. 201080029598.7, 8 pages.

* cited by examiner

PERSONAL SAFETY SYSTEM, METHOD, AND APPARATUS

CROSS REFERENCE TO RELATED APPLICATION

The present application is a continuation of U.S. patent application Ser. No. 12/775,296, filed May 6, 2010, now U.S. Pat. No. 9,177,455, which claims the benefit of and priority to U.S. Provisional Patent Application Ser. No. 61/176,421, entitled "PERSONAL SAFETY SYSTEM, METHOD, AND APPARATUS," filed May 7, 2009, assigned to the same assignee as the present application. Both Ser. No. 12/775,296 application and 61/176,421 provisional application are hereby incorporated herein by reference in its entirety.

TECHNICAL FIELD

The present disclosure generally relates to safety and communication systems, and in particular but not exclusively, relates to a system, method, and apparatus to capture and communicate data (such as images, audio, and/or other data) in order to help stop the perpetration of a crime.

BACKGROUND INFORMATION

Theft and violent crime are unfortunately common occurrences in today's society. Despite the presence of law enforcement, vigilance by citizens (such as block watches), and other efforts to deter crime, criminals are often able to succeed in committing their crimes.

There are several reasons why criminals are successful in committing their crimes. For example, law enforcement officers simply cannot be present everywhere at once. Further, the lack of potential witnesses (such as in a secluded location) often encourages criminals or would-be-criminals to commit a crime, since they believe that nobody is or will be present to identify them, and hence, they believe that the chances of ultimately getting caught are minimal. Even where security cameras are provided, the presence of such does not necessarily help to deter a crime, since the "security tape" might be easily accessible and thus can be destroyed by the criminal before fleeing the crime scene.

BRIEF SUMMARY

According to one aspect, a method comprises:

capturing, by an electronic device placed on a user, data associated with a potential perpetrator of a crime against the user;

sending, by the electronic device, the captured data to a secure and remote storage location, wherein said capturing and sending cannot be reversed or canceled by the user or potential perpetrator; and notifying the potential perpetrator that the potential perpetrator's data has been captured by the electronic device, so as to attempt to discourage the potential perpetrator from further proceeding with the crime.

In one embodiment, said capturing of the data includes obtaining one or more images, audio, environmental condition information, date, time, or location, including one or more images or audio of the potential perpetrator.

In one embodiment, the method further comprises activating the electronic device so as to trigger said capturing the data, including remotely activating the electronic device by other than the user.

In one embodiment, said activating includes activating the electronic device in response to voluntary user activation of the electronic device.

In one embodiment, said activating includes activating the electronic device in response to involuntary user activation of the electronic device.

In one embodiment, the method further comprises sending, by the electronic device, a message to law enforcement or to 911 or to some other third party to indicate that said sending of the captured data has occurred.

In one embodiment, said notifying includes electronically notifying from the electronic device, including an audible or visual notification emitted from the electronic device.

According to another aspect, an article of manufacture comprises a tangible computer-readable medium having computer-executable instructions stored thereon and executable by a processor to perform the method.

According to still another aspect, an apparatus comprises:

an electronic device to be held or worn by a user, the electronic device being configured to:

capture data associated with a potential perpetrator of a crime against the user;

send the captured data to a secure and remote storage location, wherein said capture and send cannot be reversed or canceled by the user or potential perpetrator; and notify the potential perpetrator that the potential perpetrator's data has been captured by the electronic device, so as to attempt to discourage the potential perpetrator from further proceeding with the crime.

In one embodiment, said captured data includes one or more images, audio, environmental condition information, date, time, or location, including one or more images or audio of the potential perpetrator captured by a camera and/or microphone of the electronic device.

In one embodiment, the electronic device is further configured to be activated voluntarily or involuntarily by the user, so as to trigger said capture of the data.

In one embodiment, the electronic device is further configured to send a message to law enforcement or to 911 or to some other third party to indicate that the captured data has been sent to the secure location.

In one embodiment, the electronic device includes a visual or audio component to perform said notify by emission of an electronic notification.

In one embodiment, the electronic device includes at least one sensor configured to sense biometric information, motion, location information, environmental information, or hand pressure applied to the electronic device.

In one embodiment, the electronic device is further configured to be remotely activated by someone other than the user.

According to yet a further aspect, a system comprises:

secure storage means for remotely storing data, associated with a potential perpetrator of a crime against a user, captured by an electronic device worn or held by the user; and communication means for receiving the captured data from the electronic device and for providing the stored captured data to an authorized party, wherein said storing and said receiving cannot be reversed or canceled by the user or potential perpetrator.

In one embodiment, the system further comprises means for certifying that the secure storage means stores the captured data in a format that is pristine, genuine, secure, and admissible in a court of law.

In one embodiment, said authorized party includes law enforcement.

In one embodiment, wherein said captured data includes one or more images, audio, environmental condition information, date, time, or location, including one or more images or audio of the potential perpetrator.

In one embodiment, wherein said secured storage means includes a server including or coupled to a storage unit.

BRIEF DESCRIPTION OF THE SEVERAL VIEWS OF THE DRAWINGS

Non-limiting and non-exhaustive embodiments are described with reference to the following figures, wherein like reference numerals refer to like parts throughout the various views unless otherwise specified.

DETAILED DESCRIPTION

In the following description, numerous specific details are given to provide a thorough understanding of embodiments. The embodiments can be practiced without one or more of the specific details, or with other methods, components, materials, etc. In other instances, well-known structures, materials, or operations are not shown or described in detail to avoid obscuring aspects.

Reference throughout this specification to "one embodiment" or "an embodiment" means that a particular feature, structure, or characteristic described in connection with the embodiment is included in at least one embodiment. Thus, the appearances of the phrases "in one embodiment" or "in an embodiment" in various places throughout this specification are not necessarily all referring to the same embodiment. Furthermore, the particular features, structures, or characteristics may be combined in any suitable manner in one or more embodiments.

Various embodiments provide a system, apparatus, and method referred to herein as an image, audio, and data capture and transport system (IADCTS), which utilizes digital audio and/or image technology, wired and/or wireless transfer technology, private or public networking, and GPS or other location technology to more effectively prevent crimes from happening, keep them from escalating when they do occur, and make it easier for authorities to catch and successfully prosecute criminals. In one embodiment, the IADCTS captures crime scene information, moves one or more copies of the information instantaneously from the scene, and stores the information in secure and pristine condition until accessed by law enforcement. In another embodiment, alternatively or additionally to law enforcement, the stored information may be accessed by the user, any person authorized by the user, or any person that has been properly granted access rights to the stored information.

In one embodiment, an alert or other notification is provided to the potential perpetrator of the crime, with such notification informing the potential perpetrator that his/her image (for example) has been captured and sent to a remote secure location. By capturing the crime scene information (e.g., the images of the potential perpetrator of the crime) before the crime is about to be committed or otherwise at an early stage of the crime and by providing the notification, one embodiment thus attempts to prevent the crime from further proceeding—the potential perpetrator would hopefully be discouraged by the fact that his/her image or other identification information has been provided to the secure location that can be accessed by law enforcement.

Figure 1:
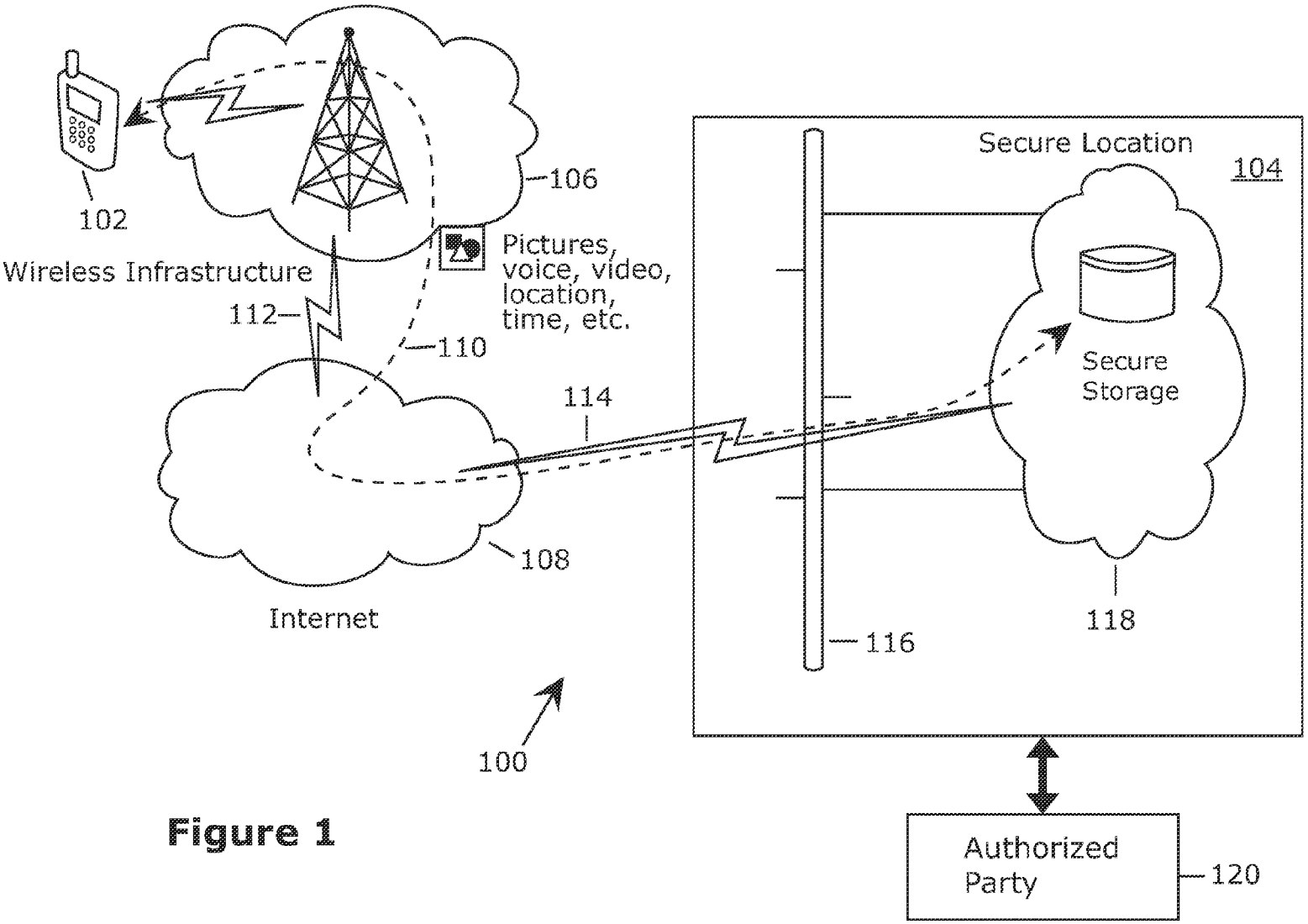
FIG. 1 is a diagram of a network that can implement an image, audio, and data capture and transport system (IADCTS), in accordance with one embodiment.

Referring first to FIG. 1, shown generally at 100 is an example of a network that can implement the various devices of an IADCTS according to one embodiment. In the network 100, an electronic device 102 can be placed on or near a user. As will be described in further detail below, the electronic device 102 can be worn or held by a user, and is configured to capture information (e.g., image, audio, and/or other data) associated with a potential perpetrator of crime, send the captured information to a secure location 104, and provide a notification to the potential perpetrator that his/her image, audio, etc. has been captured and sent to the secure location 104.

In one embodiment, the electronic device 102 comprises a wireless device that is configured to communicate with a wireless infrastructure 106 and the Internet 108 (or other network). Examples of the wireless infrastructure 106 can include, but not be limited to, a cellular network, CDMA, GSM, WiMax, satellite system, GPS, and the like. The Internet 108 is communicatively linked to the secure location 104, thereby providing a secure communication path 110 between the electronic device 102 and the secure location 104.

FIG. 1 shows at least two of the communication links 112 and 114 along the communication path 110. In some embodiments, the various communication links 112 and 114 shown in FIG. 1 can all be wireless links. In other embodiments, the communication links 112 and 114 can be a combination of wired and wireless links.

According to one embodiment, the secure location 104 comprises a firewall 116 or other security feature to protect the integrity, accessibility, etc. of the information stored in the secure location 104. One possible example of the secure location 104 is a secure data center.

The secure location 104 includes one or more secure storage portions 118 configured to store the information captured and sent by the electronic device 102. In one embodiment, the secure storage portion 118 can comprise a server or a group of servers (such as in a server farm) that are configured to store the captured information therein and/or that are operatively coupled to separate storage devices (such as memories, disks, databases, tapes, etc.) that store the captured information.

One or more authorized parties 120 can be provided with access to the information stored in the secure location. In one embodiment, access authorization may be given to a very limited number of parties, such as to only law enforcement. Limiting access to just law enforcement, for example, helps to ensure that the stored information maintains its integrity and reduces the risks of tampering by other third parties. In such embodiments, the stored information may be made inaccessible to the user (e.g., the user can send information for storage but cannot thereafter access the stored information), so as to further help to prevent any possible tampering, fraud, and/or destruction by the user, by someone who obtains access rights from the user (whether voluntarily or involuntarily), or by other unauthorized parties. For example, if the user is provided with access rights to the stored information, it may be possible for the perpetrator to threaten the user with further harm unless the user grants the perpetrator with access rights to the stored information—by not providing the user with any access rights to the stored information, the perpetrator would thus have little or no incentive to try to threaten/harm the user in order to obtain access rights for purposes of destroying or tampering with the stored information. Furthermore, by preventing the user from having access, the possibility of fraud or tampering by the user can be reduced.

While the embodiments described above provide restricted access to the stored information and do not provide the user with access, other alternative embodiments for other applications/implementations may permit a broader range of access to the stored information. In such alternative embodiments, perhaps the user and/or parties authorized by the user may be given access rights to the stored information.

Figure 2:
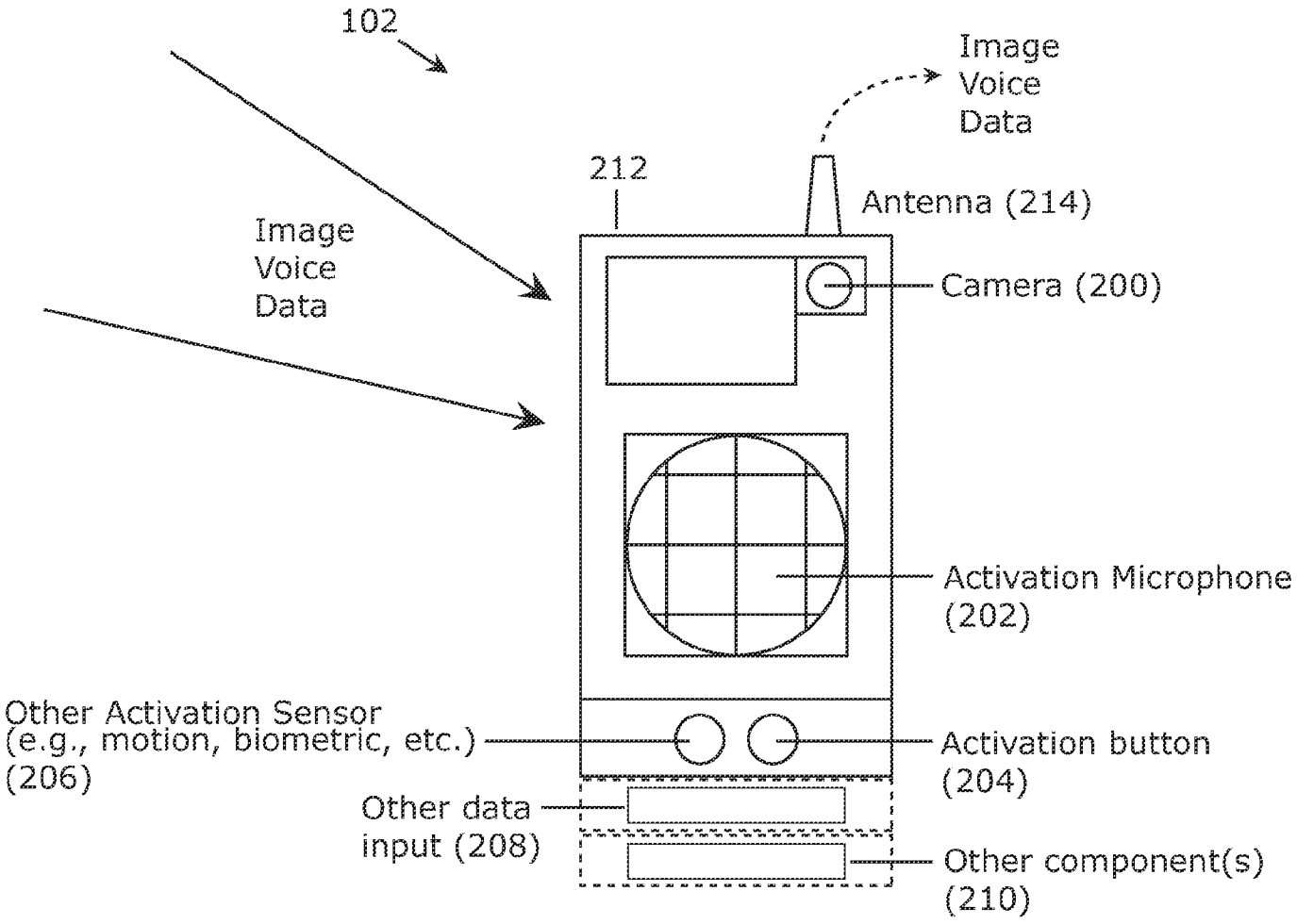
FIG. 2 is a diagram of a user device for the IADCTS, in accordance with one embodiment.

FIG. 2 shows an example of the electronic device 102 according to one embodiment. The features of the electronic device 102 of one embodiment may be implemented in some of the common commercially available wireless communication devices, such as a cellular telephone, Blackberry, Palm device, iPhone, pager, GPS unit, portable PC, iPod, and others. In some implementation, a specifically dedicated/manufactured/customized electronic device 102 may be provided, instead of integrating the IADCTS features into common commercially available products.

The electronic device 102 according to various embodiments may include one or more of the following components:

A. A camera or other image-capture device 200 configured to capture a single image, multiple images, and/or video of the perpetrator and surrounding crime scene. In some embodiments, conventional "camera phone" types of devices may be used for the image-capture device 200. In other embodiments, more advanced and higher quality cameras can be used, such as cameras that provide higher resolution and other enhancements to improve image quality.

B. A microphone 202 that can be configured as an "activation microphone." For example, the user can scream or say "HELP!" or similar phrase(s) when confronted by a potential perpetrator, thereby triggering the electronic device 102 to begin taking pictures and/or to begin transmitting the data (e.g., pictures and other information) to the secure location 104. Alternatively or additionally to being an activation microphone, the microphone 202 may be used to capture audio that accompanies the images/video captured by the camera 200, including the voice/statements made by the perpetrator. The microphone 202 may also be configured to provide audio notification to the perpetrator, such as "Stop what you are doing. Your image has been captured and has been sent to a secure location for viewing by law enforcement."

C. An activation button 204 configured to activate the image-capture device 200 and the microphone 202. For example, alternatively or additionally to voice activation, the activation button 204 can be voluntarily pressed by the user in order to trigger the image capture. The activation button 204 can be embodied as a physical button, a touch screen or touch pad, or other device that senses finger pressure and/or finger/hand presence.

D. One or more other sensors 206 that can be used for activation if the user does not or cannot otherwise use the activation button 204 or activation microphone 202. For example, activation of the image capture process can be triggered by a biometric sensor (which senses increased temperature or heart rate of the user, thereby indicating the existence of a possible danger situation), a motion sensor (which senses running, falling, rolling, etc. by the user), or other type of sensor.

E. One or more other data input devices 208 configured to capture image(s), audio (such as voice), location data, environmental conditions (time, temperature, brightness, etc.), and other data that may be potentially useful in identifying the perpetrator and the crime scene. The data input devices 208 can include additional cameras, microphones, touch pads or other pressure sensor, biometric sensor, GPS unit, and the like.

F. Other components 210, such as a processor and a tangible computer-readable medium (such as a memory or other hardware storage device). The computer-readable medium may store, for example, software or other computer-readable instructions that are executable by the processor to control and operate the data capture process described herein. The other components 210 may also include the various communication elements (such as a modem, transmitter/receiver, encoder/decoder, etc.) that can be used to transmit the captured data to the secure location 104 via an antenna 214. In one embodiment, components 201 can include user preferences on settings, timing of taking pictures, transmitting, sequence of actions or buttons to trigger certain actions, etc. For the sake of simplicity of explanation herein, not all of the possible components 210 that may be present in the electronic device 102 are shown or described herein.

According to one embodiment, the components of the electronic device 102 described above may be coupled together and held in a housing 212, thereby providing the user with the full features and functionality within a single portable device. In other embodiments, some of the components of the electronic device 102 may be separate from the housing 212. For example, the camera 200 might be a separate device worn on a lapel or miniaturized into a button or other article of clothing worn by the user, and then coupled wirelessly or hardwired to the rest of the components residing within/on the housing 212.

Figure 3:
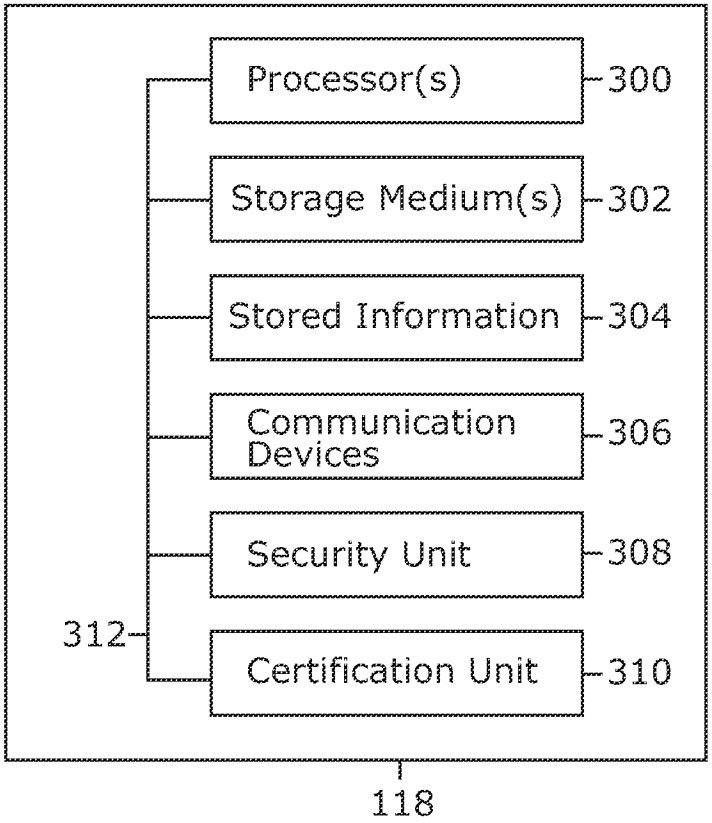
FIG. 3 is a diagram of a secure storage portion of the IADCTS, in accordance with one embodiment.

FIG. 3 shows one embodiment of the secure storage portion 118 at the secure location 104. For the sake of simplicity of explanation, the secure storage portion 118 may at times be described herein as being one or more servers that is made up of hardware and software components. However, the secure storage portion 118 may comprise other types of network devices having components that may be contained within a single physical device, or the secure storage portion 118 can be embodied as a distributed system or subsystem of discrete devices.

The secure storage portion 118 of one embodiment may include one or more of the following components:

A. One or more processors 300 coupled to one or more tangible computer-readable storage mediums 302 having computer-readable instructions stored thereon. For example, the computer-readable instructions can include an application program, computer code modules, or other software executable by the processor 300 to perform some of the functionality of the IADCTS described herein, such as controlling the receiving and storing of captured data, securing the captured data, transmitting the captured data to law enforcement, and so forth. The storage medium(s) 302 can be in the form of memory, disks, magnetic tape or other magnetic storage devices, optical storage devices, and the like.

B. Stored information 304 (such as the captured data that was sent by the electronic device 102). The stored information 304 can be kept in the storage medium 302 or other storage unit, and can be arranged in any suitable manner, such as in a database format, a file system, a directory format, and so forth. The stored information 304 can also include other types of data, such as real-time stamps of the captured data, information about the user (such as user profile information, biographic data, and so forth), information about the electronic device 102 of the user (such as device, feature, and software types and versions), identification and contact information for parties 120 authorized to access the stored data, passwords and other security features, certification information, and the like.

C. Communication devices 306 configured to communicate with the electronic device 102, authorized party 120, and other parties having access rights to the stored information, via the various communication links shown in FIG. 1. Examples of the communication devices 306 can include a modem, transmitter/receiver, browser, and the like.

D. A security unit 308 configured to restrict access to the stored information, such as via password, authentication, and other security technique that may work in conjunction with or independently of the firewall 116. The security unit 308 can also be configured to encrypt or otherwise increase the security of the stored information.

E. A certification unit 310, which can be embodied as a hardware or software device or both, configured to certify that the information stored in and to be stored in the secure storage portion 118 is pristine, genuine, secure, and admissible in a court of law. For example, the certification unit 310 can be embodied as a user interface to a computer program or other hardware and/or software tool, usable by law enforcement or the judiciary, to place stamps on the stored information to certify that the secure storage portion 118 is operating properly in order to meet evidentiary standards. The certification unit 310 may be used on a regular basis to update the certification, so as to confirm that the secure storage portion 118 is operating properly (including confirming that the integrity of the stored data is being adequately preserved), in a manner somewhat analogous to gas station pumps that are regularly inspected by the authorities to ensure that the correct volume of fuel is being dispensed and measured.

The various components of the secure storage location 118 can be communicatively coupled to each other via one or more buses 312. As explained previously, some embodiments may distribute the components of the secure storage location 118 amongst discrete remote devices. Hence, the bus(es) 312 can comprise intra-bus or inter-bus devices, wired or wireless communication links, and the like.

Figure 4:
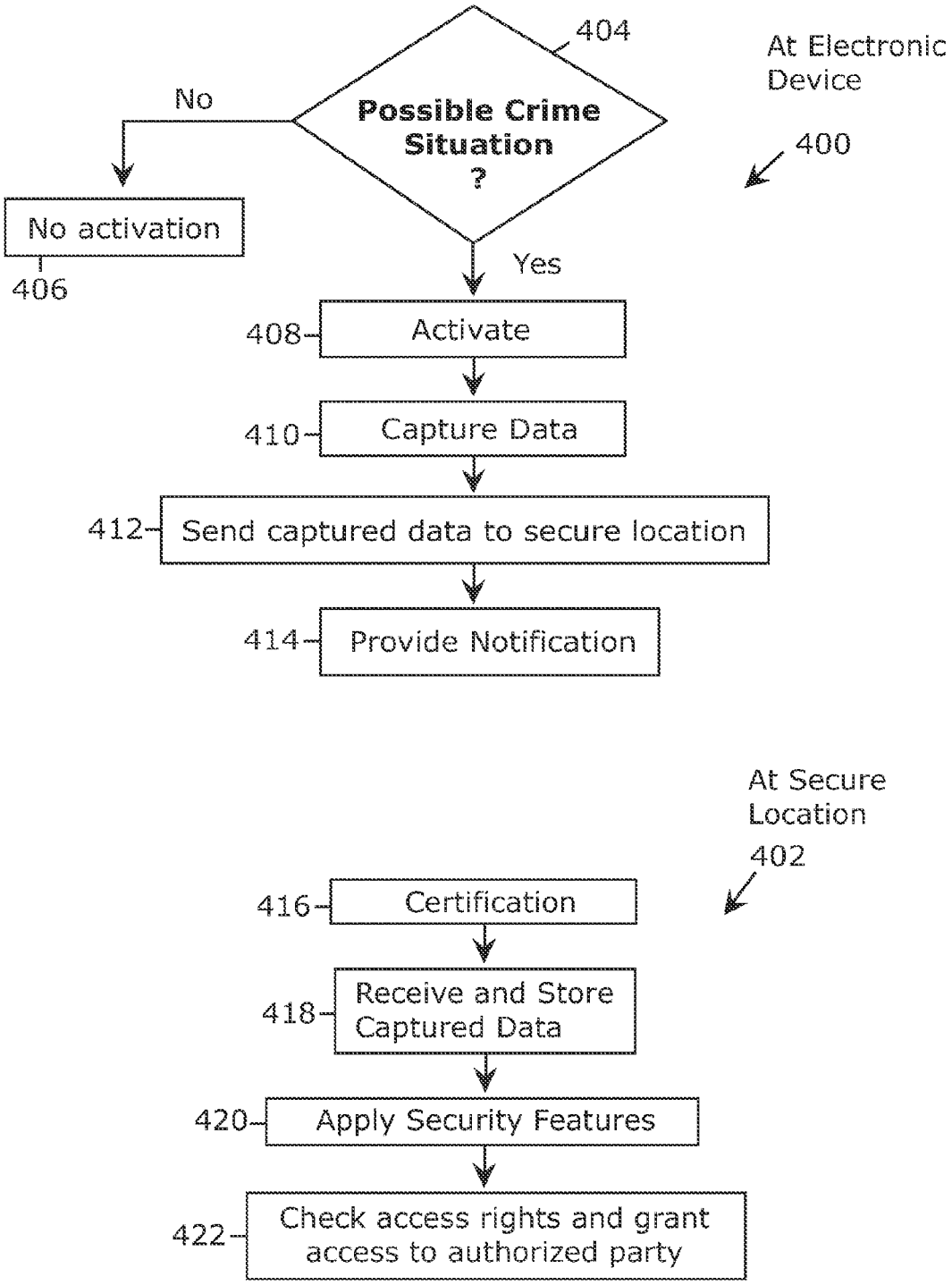
FIG. 4 is a flowchart illustrating an example operation of the IADCTS, in accordance with one embodiment.

FIG. 4 is a flowchart illustrating operation of the IADCTS according to one embodiment, including operations 400 at the electronic device 102 of the user and operations 402 at the secure location 118. In one embodiment, at least some of the operations in the flowchart of FIG. 4 may be implemented in software or other computer-readable instructions stored on a tangible computer-readable medium and executable by one or more processors. Examples of the processors and computer-readable mediums were previously described above.

The various operations in the flowchart of FIG. 4 need not necessarily occur in the exact order shown. Moreover, certain operations can be omitted, added, combined, etc. amongst the embodiments.

Starting first at the operations 400 at the electronic device 102, the electronic device 102 and/or the user detects a possible crime situation at a block 404. If it turns out that there is no crime situation, then the IADCTS features of the electronic device 102 are not activated at a block 406. If, however, a crime situation is indeed present, then the IADCTS features of the electronic device 102 are activated at a block 408.

Activation of the IADCTS features in turn triggers data capture by the electronic device 102 at a block 410. The data capture can include, for example, capturing images, video, audio, environmental conditions, location information, date and time information, and the like.

The electronic device 102 sends the captured data to the secure location 104 at a block 412. The electronic device 102 provides a notification to the perpetrator at a block 414 that his/her data has been captured and sent to the secure location 104. In this manner, the perpetrator is hopefully discouraged from further proceeding with the crime.

Now moving to the operations 402 at the secure location 104, certification can be made at any suitable time at a block 416 to certify that the data stored in and to be stored in the secure location 104 is pristine, authentic, and secure.

The secure location 104 receives and stores the captured data at a block 418. The secure location 104 may thereafter apply security features to the stored data, such as encryption, password protection, authorized access listings, etc.

If an authorized party, such as law enforcement, later requests access to the stored information, the secure location 104 can check the access rights of the requesting party and grant access at a block 422 if the access rights are verified.

To further describe and illustrate, example features and functions of various embodiments of the IADCTS are as follows:

When an IADCTS subscriber (the user) is about to travel alone, he or she engages the IADCTS by turning on the electronic device 102 of FIG. 2. At this time, the user may be asked to optimize their electronic device 102 to ensure optimal performance of the IADCTS. Upon engagement (such as in a potential crime situation), the IADCTS feature of the electronic device 102 begins to take a series of pictures at a consistent pace that may or may not be approximately one picture every few seconds, as one example. This constant image- or data-capture increases the likelihood that a perpetrator's image is captured, even if the perpetrator acts very quickly. If activated, the IADCTS camera 200 may take a single photo, a series of photos, or video. This process can continue until the IADCTS feature on the electronic device 102 is disengaged by the user/subscriber or otherwise deactivated.

The image-capture process might be accomplished utilizing one or more devices: an IADCTS miniature camera that could be affixed to the user's clothing; a mobile phone camera; a free-standing camera, existing conventional data capture equipment, or any other suitable device that captures digital stills and/or video. Audio capture may also occur at this time, such as to capture the voice of the perpetrator and/or other people in the vicinity, the ambient noise in the environment, or any other audio that may be usable to determine the persons involved, the location, day and time, and/or the situation.

Either when the IADCTS feature on the electronic device 102 is activated or when it is broadcasting/transmitting to the secure location 104, the user may elect for a flash to go off or provide other notification in one embodiment. In an alternative embodiment, a flash may or may not take place, even in settings where successful image capture does not require it.

This flash (in the form of a bright light in one embodiment) can operate to provide sufficient lighting for image capture, and/or to provide a visual warning or other indicator/notification to the perpetrator that their image has been and continues to be captured. Such a flash warning operates to deter the perpetrator from continuing to commit the crime.

Whether wireless and/or wired technology is used, when an IADCTS user feels threatened, the user may initiate instant broadcast of the captured imagery (via an access device and network, such as depicted in FIG. 1) to at least one secure central server and/or third party networks and/or other secure location that may or may not be accessed by user-approved law enforcement, government, or security entities. Such broadcast of imagery may or may not be initiated via the user's choice of commands, including but not limited to, hand, voice, biometrics, movement activation, a switch, or remotely. Examples such as shown in FIG. 2 may include a button or other activation device that the user/subscriber physically activates, motion sensors, audio sensors (such as if the user shouts), biometric sensors (such as if it is sensed that the user's heart rate/temperature/etc. suddenly increased past a set threshold, indicating a panicked or other heightened-awareness situation). A decelerometer or other motion sensor device may be built into the IADCT, so that even if the user does not purposely broadcast the captured images, they will be broadcast automatically, based on sudden movement.

When a user is aware of danger before the perpetrator instigates a confrontation, the user may have time to aim the IADCTS device with purpose at the instigator. Regardless of such actions, images can be captured and transmitted that could include views of the perpetrator and surrounding environment, detailed views of physical characteristics of the perpetrator (such as scars, moles, eye color, etc.), other features of the perpetrator (including clothing), views of the weapons used in the crime, etc. Whatever kind of image capturing device is used, the IADCTS of one embodiment may automatically stamp the images with a sequence number, the time of day, GPS coordinates, and other pertinent information. In venues where existing captured video exists, such video can be instantly converted and sent as a communication, such as a broadcast, unicast, multicast, webcast, email, IM, or other type of communication message.

The secure location 104 can be certified as being secure, so as to substantially guarantee that the information stored therein becomes admissible in criminal and/or civil court or other legal proceeding. Notifications and/or copies of the entire or parsed data file may or may not also be automatically generated and sent to additional user-approved parties, using a variety of technologies, including but not limited to, Short Message Service (SMS), email, voice call, Multi-Media Service, etc. For example, messages can be sent to the parent of a child wearing the IADCTS, so as to notify the parent of the incident, location, persons involved, etc. A wide variety of broadcast or other communication technologies can be utilized to communicate the image(s), audio, and/or data to the secure IADCTS server, including but not limited to cellular, Bluetooth, infrared, WiFi, EVDO, HSPDA, WiMax, and others, using for example a radio or other communication device on the electronic device 102.

After the data is sent, which is a process that the user and/or perpetrator(s) cannot stop from happening and cannot un-do or reverse in one embodiment, the IADCTS system may automatically invoke an enhanced 911 notification so authorities know that a situation has arisen. This notification may occur immediately or after a pre-set number of seconds after the electronic device 102 begins transmitting imagery, for example. Providing the feature in one embodiment of not permitting the user to un-do or reverse the data capture and transmission (for storage) process provides an extra layer of protection for the user. For example, the perpetrator may be less likely to continue to threaten or assault the user in order to force the user to stop the process, delete the pictures, etc., since the user has no such capability in one embodiment. Thus, the perpetrator may be more likely to just flee, rather than to further proceed with committing the crime.

Once the image and/or other data have been transmitted, the user can inform the perpetrator that the event has been captured and is available to the police. In another embodiment, the electronic device 102 can provide the notification to the perpetrator, such as via an automated audio message, siren, etc. By capturing an event's and/or perpetrator's image/voice at the very outset of a confrontation—usually before any harm can be done—the IADCTS thus creates a situation in which the perpetrator's self interest is clearly best served by disengaging and running away before the seriousness of their crime can escalate, thereby discouraging the crime from being continued/escalated. In this way, the IADCTS may work first as a deterrent to crime, and second as a successful crime solving tool.

The secure location 104 contains the original data for immediate or future retrieval—including but not limited to—the digital photograph, digital video, voice, GPS location, and other pertinent information. Copies of the information can be provided to the subscriber and approved 3$^{rd}$ party entities, for use in criminal and/or civil proceedings, in educational/training tools, and/or for other uses in some embodiments. In other embodiments, access by the subscriber/user may be substantially limited, unless certain requirements are met (such as by the user providing a court order that permits access). In one embodiment, at least one copy is sent to the secure server(s) at the secure location 104. Additional copies may be sent to the same secure server and/or to other servers or to other secure locations.

The following are other features/functions according to various embodiments:

- A person remote from the user (wearing the electronic device 102) can have remote control capability over the electronic device 102. For example, a parent can control the activation of the electronic device 102, retrieve information from the electronic device 102, send messages to the child wearing the electronic device 102, etc.
- The IADCTS can be used in a variety of personal, professional, public, private, civilian, and/or military applications. For example, military personnel can wear the electronic device 102, such that details of ambushes or other engagements can be captured and communicated back to the base or other secure location. As another example, law enforcement officers can wear the electronic device 102 such that their patrols and other engagements can be configured to capture images, audio, and other data when situations occur.
- Components of the IADCTS (such as at the electronic device 102 or at the secure location 104) can be embodied in software or other computer-readable instructions stored on a tangible computer-readable medium and executable by a processor. For example, software can be provided to activate the image, audio, and/or data capture, process the captured information, send the captured information to the secure location, and provide notification/warning to the perpetrator, and/or to provide or facilitate the other functions described herein.

The following provides still further description of features and functions of various embodiments of the IADCTS:

- Prevention, Protection, Identification: The IADCTS may be a personal safety system that brings the latest digital image, transmission, and location technologies together to stop crime in its tracks—capturing images of criminals "in the act" and in real time.

When an IADCTS user is about to begin walking alone, he or she engages the IADCTS features of the electronic device 102, which then begins capturing a series of pictures or video. When the IADCTS user feels threatened, he or she causes the captured images to be instantly transmitted to the secure location 104, accessible by law enforcement. Each picture may contain the time it was taken, as well as the GPS coordinates. And once the image has been transmitted, neither the subscriber nor the criminal can retrieve it.

The user may initiate image broadcast via voice, movement, or any number of other suitable methods.

Either immediately or a set number of seconds after image transmission commences (depending on the application), a 9-1-1 call may be automatically placed, notifying law enforcement of a situation.

The user and/or the electronic device 102 loudly informs the perpetrator that his photo is now on file and accessible by the police.

Stopping crimes before they start: Once a prospective thief or assailant knows that the police already has their photo, such prospective thief/assailant will likely flee the scene immediately, before a crime can escalate. Therefore and as explained throughout herein, the IADCTS may act as both as a crime deterrent and as a crime-solving tool.

Assisting the police as well as the public: Unsecured images can be tampered with, greatly decreasing their effectiveness in suspect identification and crime prosecution. However with one embodiment of the IADCTS, all images may be time-stamped and sent to a secure server, where the images or other data cannot be tampered with before being accessed by law enforcement. In addition, this imagery or other data might give the police a more reliable way to search for suspects, compared to inexact or conflicted eyewitness descriptions. This, in turn, might lessen the number of unnecessary suspect detentions, as well as the kinds of lawsuits that result from such detentions.

To further illustrate features of various embodiments, the following example usage scenarios are provided herein:

A. Example Usage Scenario 1

Mary is a 19-year-old college student. One evening, she is doing homework in the library until it closes at 10:00 PM. As she prepares to leave the library and walk to her dorm alone, she engages her IADCTS application by touching an icon on her electronic device 102 (such as an i-Phone) and making sure that the volume is maximized and that there is sufficient battery life.

As she walks toward her dorm, the electronic device 102 is capturing images every few seconds. Each image is stamped with both the time of day and the GPS coordinates of the location and/or other information. In the distance, Mary sees two men walking towards her. They do not look menacing, but she does not know them. With her level of attention increased, she positions the electronic device 102 in such a way that it is pointing as directly as possible at the two men. She is also ready to tap the screen (e.g., a touch sensor) of her electronic device 102 quickly should something happen.

As the two men come within 15 feet of her, they suddenly alter their direction and pick up their pace to come directly towards her. She now becomes afraid for her safety and taps the screen of her electronic device 102, at which several things may happen simultaneously, in sequence, or in any appropriate order:

An additional image is captured instantly, and all images from the last two minutes of her walk are transmitted to a remote secure server (e.g., at the secure location 104);

An email or other notification is sent to law enforcement, alerting them that an IADCTS transmission has been sent by Mary;

A series of emails or other notification(s) indicating that an IADCTS transmission has been made are sent to pre-determined entities that may include, but are not limited to, friends, family members, and law enforcement officials;

A call is automatically placed to 911.

One of the men grabs Mary while the other takes her backpack and asks where her money is. She yells that their picture has been taken and transmitted to the police. One of the men grabs her electronic device 102 and looks at the screen, which confirms what she has said. At this same time, a 911 operator comes on the line.

The two men, knowing that they have been positively identified, drop everything and run away. Mary talks to the 911 operator, tells him/her what has happened, and hurries to her dorm where police meet her to discuss the incident.

Photos from the incident are later shown by the police around campus. One of the two men is identified and arrested, and he tells authorities the name of his accomplice.

B. Example Usage Scenario 2

Loraine is a 37-year old professional woman on a business trip. There is a park near her hotel, and so she decides to go for a jog during the early evening. She has an IADCTS-enabled device with her, but does not engage it, since there are many people in the park.

However, she runs longer and further than she intended and, upon heading back to her starting point, she realizes that the park is nearly empty and it is getting dark. She then activates the IADCTS features on her electronic device 102 and continues jogging as images are captured.

Coming the other direction is a man. He looks older, is walking slowly and with a limp, and is actually a bit shorter than Loraine . . . very non-threatening. She feels safe and continues to run. Just as she beings to pass the man, the man straightens up and takes a big swing, which knocks her to the ground, semi-conscious, and knocks the electronic device 102 out of her hands.

Though she did not make an active decision to transmit her time-stamped, GPS-linked images to the secure location 104, the acceleration and impact of her electronic device 102 hitting the ground automatically causes the transmission to be made anyway. In addition, automatic emails or other notification(s) are sent to the police and her husband.

With this embodiment of the IADCTS, two more things may also occur. A flash of light is emitted, startling the perpetrator, and an audible warning informs him that images have been transmitted and are available to the police.

The perpetrator picks up the electronic device 102 and sees that images have indeed been sent. He shakes Loraine and demands her to re-call the images or otherwise cancel the process. She says that it cannot be done, just as a 911 operator comes on the line. He runs away. Loraine is still shaken and startled, but the 911 operator has her location and police soon arrive.

The captured images cannot identify the perpetrator because he had his head down, but the electronic device 102 also captured his voice, which is used to facilitate a conviction when Loraine later picks the man out of a police line-up.

C. Example Usage Scenario 3

Susan is an 11-year-old girl, who generally walks most of the way home with a group of girls. However, for the last quarter mile, she walks alone. Her parents purchased a dedicated IADCTS-enabled device for Loraine, which is pinned to the front of her blouse. She is supposed to wear the device when walking home, but today she has forgotten to arm it.

A predator, sitting in a van, sees Susan walking towards him when she is alone and not quite home. He lures her to his van, saying he needs directions, and when she gets close, he drags her inside, subdues and binds her, and drives off.

Noting that Susan has not returned home, her mother remotely engages Susan's electronic device 102. The IADCTS features immediately begin collecting imagery and other data, and the built-in GPS capability indicates that Susan is moving in a direction she should not be. Her mother then remotely activates an IADCTS transmission of images or other data, and then calls the police to tell them what is happening.

Back in the perpetrator's van, an audible warning goes off. The electronic device 102 captures and transmits an image of him. Knowing that he has likely been detected, the perpetrator pulls the van over to the side of the road. He hears the voice of a 911 operator, at which time he rips the electronic device 102 off Susan and smashes it.

Making some quick decisions, he realizes that he cannot risk going further with this crime, since the authorities likely now have his photo. He drives to an area away from the main road, leaves Susan unharmed, and drives off.

Meanwhile, the police have been contacted by the mother and have also received an email or other notification from the electronic device 102 and/or from the secure location 104. Since the GPS device (located on the electronic device 102) has been destroyed by the perpetrator, officers are sent to the last known location. After half an hour of searching, they find Susan. She is shaken but otherwise unharmed.

The photo of the perpetrator captured by the electronic device 102 is clear. He is a registered sex offender who has now fled. However, he is apprehended the next day in another state.

D. Example Usage Scenario 4

Molly works late hours in an office building. At 11:30 PM, she takes the elevator to the basement parking garage. A predatory man is waiting for an unescorted woman to exit the elevator. As Molly begins walking to her car, he begins walking towards the elevator, which means they will pass each other. Molly has her IADCTS features engaged and so images are being taken, but she feels safe.

The predator is just getting ready to attack when he sees the electronic device 102 on Molly's lapel. Having heard of the IADCTS through the media, advertisements, or word of mouth, he does not attack and instead passes by without engaging in any verbal or physical contact with Molly.

Molly gets in her car and goes home, never realizing how close she came to being accosted.

E. Example Usage Scenario 5

The information stored in the secure location 104 can be used, alternatively or additionally, by law enforcement investigation and court evidence, for other commercial or non-commercial purpose. For example, the owner of the data and/or the owner of the secure location 104 can license or sell the stored content for use by third parties. Example uses can include use of the data for training purposes, for entertainment purposes (such as for reality-type television programs that show crimes "caught on tape"), for personal use by the user, etc. just to name a few examples.

Suitable business models can be put in place to share or otherwise distribute revenue (from sale or licensing of the data) between the user or other owner of the stored data and the operator of the secure location 104.

In such alternative uses, one embodiment of the IADCTS can be configured with safeguards such that the prospective commercial or non-commercial use does not prejudice or otherwise adversely affect the integrity of the stored data and the means by which the data was captured. For instance, if the data is to be used first or primarily for court or police investigation, then safeguards may be put in place to ensure that the information to be stored is for the primary purpose of ensuring and preserving the integrity of the information for evidence, rather than for profiteering. As an example, the stored data may not be intended and/or permitted to be used for commercial purposes until after a certified copy of the data is provided to law enforcement and used in a court of law and/or until after such enforcement/legal proceedings are finally resolved/terminated.

In one embodiment, a version of the data, disassociated or otherwise made anonymous with respect to the user, and/or potential perpetrator, and/or other parties, locations, date, etc. can be provided for commercial purposes or other purposes.

In some embodiments, the stored information may be accessible by the user, such as if the user wishes to capture real-time life experiences on video, and then later wish to securely view the captured images. A fee or subscription arrangement can be provided by the secure location 104 to the user or other parties for such services. In such embodiments, the captured images need not necessarily relate to criminal activity, and may in fact involve images of a pleasant experience for the user.

All of the above U.S. patents, U.S. patent application publications, U.S. patent applications, foreign patents, foreign patent applications and non-patent publications referred to in this specification and/or listed in the Application Data Sheet, are incorporated herein by reference, in their entirety.

The above description of illustrated embodiments, including what is described in the Abstract, is not intended to be exhaustive or to limit the embodiments to the precise forms disclosed. While specific embodiments and examples are described herein for illustrative purposes, various equivalent modifications are possible and can be made.

These and other modifications can be made to the embodiments in light of the above detailed description. The terms used in the following claims should not be construed to limit the invention to the specific embodiments disclosed in the specification and the claims. Rather, the scope of the invention is to be determined entirely by the following claims, which are to be construed in accordance with established doctrines of claim interpretation.

What is claimed is:

1. A method for discouraging a potential perpetrator from proceeding with a crime against a user, comprising:

receiving, by a mobile communication device held or worn by the user, information indicating an activation event; and in response to the information indicating an activation event, capturing, by the mobile communication device, data associated with the potential perpetrator of the crime against the user holding or wearing the mobile communication device, including one or more images or audio of the potential perpetrator; and contemporaneously sending, by the mobile communication device, the image or audio data associated with the potential perpetrator, to a secure and remote storage location, wherein said capturing and sending cannot be reversed or canceled by the potential perpetrator;

wherein the potential perpetrator is contemporaneously notified that the image or audio data associated with the potential perpetrator has been captured and sent by the mobile communication device, to discourage the potential perpetrator from further proceeding with the crime.

2. The method of claim 1, wherein the receiving information indicating an activation event includes receiving information indicating activation of the mobile communication from an inactive state to trigger said capturing, contemporaneous sending and contemporaneous notifying.

3. The method of claim 2 wherein said activating includes activating the mobile communication device in response to voluntary user activation of the mobile communication device.

4. The method of claim 2 wherein said activating includes activating the mobile communication device in response to involuntary user activation of the mobile communication device.

5. The method of claim 1, further comprising sending, by the mobile communication device, a message to law enforcement or 911 or to some other third party to indicate that said sending of the captured image or audio data has occurred.

6. An article of manufacture, comprising a tangible non-transitory computer-readable medium having computer-executable instructions stored thereon that cause a mobile communication device, in response to the execution of the instruction by a processor of the mobile communication device, to perform the method of claim 1.

7. The method of claim 1 further comprising capturing, by the mobile communication device, images of a current environment surrounding the user, the capturing occurring at predetermined time intervals; wherein contemporaneously sending includes contemporaneously sending with the image or audio data of the potential perpetrator, a subset of the images of the environment captured during a predetermined time period that is immediately preceding a time the information indicating an activation event is received.

8. An apparatus for discouraging a potential perpetrator from proceeding with a crime against a user, comprising:

a mobile communication device to be held or worn by the user, wherein the mobile communication device is to:

receive information indicating an activation event; and in response to the information indicating an activation event, capture data associated with the potential perpetrator of the crime against the user holding or wearing the mobile communication device, including one or more images or audio of the potential perpetrator; and contemporaneously send the captured image or audio data to a secure and remote storage location, wherein said capture and send cannot be reversed or canceled by the potential perpetrator; and wherein the potential perpetrator is contemporaneously notified that the image or audio data associated with the potential perpetrator has been captured and sent by the mobile communication device, so as to attempt to discourage the potential perpetrator from further proceeding with the crime.

9. The apparatus of claim 8 wherein said captured image or audio data of the potential perpetrator includes date, time, or location, with respect to when and where the image or audio data were captured.

10. The apparatus of claim 8 wherein the mobile communication device is to receive the information indicating an activation event, in response to a voluntary or involuntary action of the user.

11. The apparatus of claim 8 wherein the mobile communication device is to further send a message to law enforcement or to 911 or to some other third party to indicate that the captured data has been sent to the secure and remote storage location.

12. The apparatus of claim 8 wherein the mobile communication device includes a visual or audio component to perform said notify by emission of an electronic notification.

13. The apparatus of claim 8 wherein the mobile communication device includes at least one sensor to sense biometric information, motion, location information, environmental information, or hand pressure applied to the mobile communication device, and in response, provide the information indicating an activation event.

14. The apparatus of claim 8, wherein the mobile communication device is further used to capture images of an environment surrounding the user, the capturing occurring at predetermined time intervals; and to contemporaneously send with the image or audio data of the potential perpetrator, a subset of the images of the environment captured during a predetermined time period that is immediately preceding a time the information indicating an activation event is received.

* * * * *